United States Patent [19]

Bolster

[11] 3,981,810

[45] Sept. 21, 1976

[54] GREASE COMPOSITION

[75] Inventor: Robert N. Bolster, Fairfax County, Va.

[73] Assignee: The United States of America as represented by the Secretary of the Navy, Washington, D.C.

[22] Filed: Nov. 11, 1975

[21] Appl. No.: 630,826

[52] U.S. Cl. ..... 252/32.7 E; 252/33; 252/41; 252/389 R

[51] Int. Cl.[2] ..... C10M 1/48; C10M 3/42; C10M 5/24; C10M 7/46

[58] Field of Search ..... 252/32.7 E, 33, 41, 252/389 R

[56] References Cited

UNITED STATES PATENTS

| | | | |
|---|---|---|---|
| 3,390,081 | 6/1968 | Floeck | 252/32.7 E |
| 3,493,507 | 2/1970 | Haak et al. | 252/32.7 E |
| 3,776,846 | 12/1973 | Bailey et al. | 252/32.7 E |
| 3,939,082 | 2/1976 | Williams et al. | 252/32.7 E |

*Primary Examiner*—Delbert E. Gantz
*Assistant Examiner*—I. Vaughn
*Attorney, Agent, or Firm*—R. S. Sciascia; Philip Schneider; Thomas McDonnell

[57] ABSTRACT

Grease compositions suitable for a salt water, high pressure and high shear environment over a wide temperature range which comprises from 82 to 89 weight percent of an ester-silicone oil base selected from the group consisting of a blend of isodecyl pelargonate, hexadecyl isostearate, and methyl-phenyl silicone, a blend of isodecyl pelargonate, tridecyl azelate, and methyl-phenyl silicone, and a blend of ethylhexyl adipate and methyl-phenyl silicone; from 4.9 to 7.5 weight percent of lithium stearate; from 2 to 3 weight percent of a rust inhibitor selected from the class consisting of barium and lead dinonylnaphthalene sulfonate; from 1.5 to 5 weight percent of antimony dialkylphosphorodithioate; from 0.2 to 0.6 weight percent of 2,6-di-tert-butyl-4-methylphenol and from 0.25 to 0.6 weight percent of a copper-silver corrosion inhibitor selected from the class consisting of tolyltriazol, disalicylal-propylenediamine, and 2-mercaptobenzothiazole.

5 Claims, No Drawings

GREASE COMPOSITION

BACKGROUND OF THE INVENTION

The present invention pertains to lubricants and more particularly to ester oil-silicone based greases.

Many applications for lubricants require the lubricant to operate in an environment having high pressure and high shear conditions, a temperature variation from below freezing to above the boiling point of water, a high moisure content, and a close proximity to sea water. Examples of such environment are found in naval rapid firing guns. It is required that lubricants for these guns be effective from −54° to +150°C.

Existing lubricants have had objectionable failings with regards to one or more of these environmental conditions. For example, if a lubricant provided adequate resistance to wear due to high pressure, it provided poor resistance to moisture. This low moisture resistance characteristic of the lubricant quickly caused corrosion and inoperability under icing conditions. One lubricant was sufficiently fluid, icing-resistant, and low temperature operable, but lacked sufficient resistance to wear due to high pressure.

One attempt to improve the lubricants has entailed the addition of silicones. This addition does improve the viscometric properties and moisure resistance of the lubricant, but it also increases wear and may cause compatibility problems with other lubricant components at low temperatures. The addition of effective chemical high pressure antiwear additives and corrosion inhibitors has heretofore been unsuccessful because of compatibility difficulties or a tendency of the additive to hydrolyze or to promote emulsification of the lubricant with water.

SUMMARY OF THE INVENTION

It is, therefore, an object of this invention to provide a lubricant with resistance to degradation under high shear and high pressure conditions.

Also, an object of this invention is to provide a lubricant which is highly effective from −54°C to 150°C.

Another object of this invention is to provide a lubricant with an improved adhesion to moving metal parts.

Another object of this invention is to provide a lubricant which can prevent salt water corrosion of metals.

And another object of this invention is to provide a lubricant that does not emulsify.

Still another object of this invention is to provide an icing-resistant lubricant.

And a further object of this invention is to provide an oxidation-resistant lubricant.

These and other objects are achieved by a grease comprising from 82 to 89 weight percent of an ester-silicone oil base selected from the group consisting of a blend of isodecyl pelargonate, hexadecyl isostearate, and methyl-phenyl silicone, a blend of isodecyl pelargonate, tridecyl azelate, and methyl-phenyl silicone, and a blend of ethylhexyl adipate and methyl-phenyl silicone; from 4.9 to 7.5 weight percent of lithium stearate; from 2 to 3 weight percent of a rust inhibitor selected from the class consisting of barium and lead dinonylnaphthalene sulfonate; 1.5 to 5 weight percent of antimony dialkylphosphorodithioate; from 0.2 to 0.6 weight percent of 2,6-di-tert-butyl-4-methylphenol and from 0.25 to 0.6 weight percent of a copper-silver corrosion inhibitor selected from the class consisting of tolyltrizol, disalicylalpropylenediamine, and 2-mercaptobenzothiazole.

DETAILED DESCRIPTION OF THE INVENTION

The preferred type of oil base of the present invention is a blend of two ester oils and a silicone oil of varying viscosities. A ternary blend best attains the viscometric properties and compatibility needed to provide lubrication over a wide temperature range. The first oil is to have a viscosity from 3 to 10 cS at 100°F (38°C). The viscosity of the second oil is from 18 to 40 cS at 100°F (38°C) and the viscosity of the silicone is from 25 to 45 cS at 100°F (38°C). The three ingredients are blended to produce a viscosity from 10 to 20 cS at 100°F (38°C) and from 2000 to 8000 cS at −65°F (−54°C).

A preferred composition for the oil base is a blend of isodecyl pelargonate, hexadecyl isostearate, and methyl-phenyl silicone in the amounts, based total lubricant weight, of 31 to 44 weight percent, 26 to 39 weight percent, and 13 to 22 weight percent respectively. Another preferred composition for the base is a blend, based on total lubricant weight, of 35 to 50 weight percent of isodecyl pelargonate, of 25 to 40 weight percent tridecyl azelate, and 15 to 30 weight percent of the methyl-phenyl silicone.

The second type of oil base within the scope of the present invention is a blend of 70 to 85 weight percent of ethylhexyl adipate and of 15 to 30 weight percent of methyl-phenyl silicone. All weight percents are based on total lubricant weight. The viscosity of ethylhexyl adipate is about 8 cS at 100°F. These two ingredients are also blended to produce a viscosity from 10 to 20 cS at 100°F (38°C) and from 2000 to 8000 cS at −65°F (−54°C).

The methyl-phenyl silicone used in the practice of this invention is a polysiloxane of the formula: $\frac{+R_2SiO+}{n}$, where $R_2$ forms 5 to 30 mole percent of methyl-phenyl siloxane and of 70 to 95 percent of dimethyl siloxane.

The grease forming agent to be used is lithium stearate. It is important that the lithium stearate be free of surface active impurities, e.g., sodium or calcium soaps or soaps of lower molecular weight fatty acids such as myristic or oleic acid. The maximum amount of these impurities is 3 weight percent. Surface active agents are objectionable in that these chemicals promote emulsification. From 4.9 to 7.5 weight percent of the lithium soap is used as necessary to form a grease having an apparent viscosity at 25°C from 2 to 10 Poise when measured at a shear rate of 100 $sec^{-1}$.

Several additives are compounded into grease compositions in order to improve certain properties. Selection of these additives is complicated by compatibility problems of these additives with themselves, with the ester-silicone oil base and with moisture over the wide range of temperatures. It has been found that lack of moisture resistance of additives is a major cause of a grease breaking down in extreme environments.

The first additive is a rust inhibitor. The preferred rust inhibitors are basic or neutral barium or basic lead sulfonates. The lead sulfonate has been found to provide better moisture resistance. It should be noted that barium or lead sulfonates are obtained commercially in 50% solutions in which the fluid is a light petroleum oil or a volatile solvent, such as, heptane. The volatile solvent solutions are preferred because all of the solvent is driven off during preparation of the grease.

Since the inhibitor is in a 50% solution, 4 to 6 weight percent must be added in order to deliver the required 2 to 3 weight percent. Other rust inhibitors may be used so long as water is prevented from emulsifying with the oils in the grease. Beside causing metal parts to rust by washing the grease off these parts, water emulsification is objectionable in that the water emulsion becomes stiff upon freezing of the water, thereby hindering operation of the mechanism.

The other additives are an extreme pressure antiwear additive, an oxidation inhibitor, and a copper-silver corrosion inhibitor. It is preferred that antimony dialkylphosphorodithioate in an amount from 1.5 to 5.0 weight percent of total lubricant composition is the extreme pressure antiwear additive. The alkyl groups are any alkyl having four to ten carbons or is cyclohexyl or mixtures thereof. Most commonly the alkyls have four to six carbon atoms or is cyclohexyl. A mixture of the aforementioned antimony dialkylphosphorodithioates is often used. Preferably the oxidation inhibitor is 2,6-di-tert-butyl-4-methylphenol (BHT) in an amount of from 0.2 to 0.6 weight percent of the total lubricant composition. Other substituted phenol anti-oxidants would be satisfactory provided they satisfy the other requirements for additives. The copper-silver anti-corrosion additive preferably is selected from the class consisting of tolyltriazole, disalicylal-propylenediamine mercaptobenzothiazole in an amount from 0.25 to 0.6 weight percent of the total lubricant composition.

In preparing the grease composition of this invention, the copper-silver corrosion inhibitor, if 2-mercaptobenzothiazole is selected and the extreme pressure antiwear additive are mixed by any means with a small portion (from 4 to 10 weight percent) of the ester oil(s) and dissolved therein by a gradual warming of the oil(s) from room temperature to a temperature from 105° to 110°C in at least 30 minutes. The remainder of these oils, the silicone, the other additives, and the grease forming agent are mixed by any means, e.g., a blade mixer until evenly distributed. Thereupon the mixture is heated at a rate from 10° to 20°C/min to a temperature from 195° to 200°C. When the grease forming agent is dissolved the mixture is quickly chilled, i.e., in less than 30 seconds, to room temperature, thereby forming the grease structure. The additive oil solution is now mixed into this newly formed grease. It is critical that these two additives are introduced into the grease in this manner and not heated to the solution temperature. The resulting combination is passed at least three times through a three-roll mill and daerated in vacuo. The milling further mixes the ingredients and refines the structure through the shearing action of the mill. The grease is then aged at 50°C for at least 2 days to allow the consistency to stabilize. If another copper-silver corrosion inhibitor is selected, then only the extreme pressure antiwear additive is added to a small portion of the oil(s) and then added to the composition after the grease structure has been formed.

The composition and properties of grease fluids, i.e., the base plus the additives of a number of greases within the scope of the present invention are given by way of example in Table I. The fluids plus the lithium soap constitute the complete grease.

Vanlube 622 is antimony 0,0-dialkyl-phosphorodithioate, and is manufactured by the R. T. Vanderbilt Company, Inc. The properties of this compound are: the composition is 11.5% antimony, 8.5% phosphorous, 18% sulfur; the specific gravity at 77°F is 1.20; the viscosity SUS at 100°F is 203; the viscosity SUS at 210°F is 46; the flash point (COC) is 380°F; and the pour point (ASTM) is −30°F.

Table I

Lubricant Fluid Formulations and Properties

| | A | B | C | D | E | F |
|---|---|---|---|---|---|---|
| Composition, Wt. % | | | | | | |
| Isodecyl pelargonate | 37.28 | 41.85 | | 41.6 | 41.7 | 41.7 |
| Tridecyl azelate | 27.96 | 27.9 | | | | |
| Hexadecyl isostearate | | | | 32.4 | 32.4 | 32.5 |
| Ethylhexyl adipate | | | 69.75 | | | |
| Methyl-phenyl silicone, 50 cS | 27.96 | 23.25 | 23.25 | 18.5 | 18.5 | 18.5 |
| Barium dinonylnaphthalene sulfonate (50%) | 4 | 4 | 4 | 4.5 | | |
| Lead dinonylnaphthalene sulfonate (50%) | | | | | 4.6 | 4.6 |
| Antimony dialkylphosphorodithioate ("Vanlube 622") | 1.8 | 2 | 2 | 2 | 2 | 2 |
| 2-Mercaptobenzothiazole | 0.6 | 0.6 | 0.6 | 0.6 | 0.4 | 0.3 |
| Antioxidant (BHT) | 0.4 | 0.4 | 0.4 | 0.4 | 0.4 | 0.4 |
| Falex Wear Tests | | | | | | |
| Unit pressure, psi, 1000 lb. load | 55,400 | 66,900 | 57,000 | 80,200 | 75,300 | 73,700 |
| Unit pressure, psi, 2000 lb. load | 65,500 | 63,100 | 67,700 | 81,100 | 60,500 | 63,700 |
| Step test seizure load, lb. | >3500 | >3500 | >3500 | >3500 | >3500 | >3500 |
| Unit pressure, psi, step test | 75,500 | 114,800 | 127,000 | 175,900 | 87,900 | 126,000 |
| Viscosity, centiStokes | | | | | | |
| At 100°F | 15.6 | 14.3 | 12.1 | 13.7 | 13.5 | 13.5 |
| At −65°F | 4200 | 4180 | 4100 | 4500 | 4500 | 4500 |
| Tarnishing | | | | | | |
| Copper | | Exc. | | Exc. | Fair | Fair |
| Silver | | Good | | Fair | Good | Good |

For purposes of comparison, the composition and properties of the lubricant currently approved for rapid-fire naval automatic weapons operating within a temperature range of −54°C to 150°C is given in Table II.

Table II

| Lubricant Formulation and Properties | |
|---|---|
| Material | Percent by weight |
| Lithium stearate | 8.0 ± 0.3 |
| Bis(2-ethylhexyl)sebacate | 89.0 ± 1.0 |
| Diisopropyl phosphite | 1.0 ± 0.2 |
| 2,6-di-tertiary-butyl-p-cresol | 0.5 ± 0.1 |
| Barium dinonylnaphthalene sulfonate | 1.5 ± 0.3 |
| **Falex Wear Tests of Oil** | |
| Unit pressure, psi, 1000 lb. load | 69,300 |
| Unit pressure, psi, 2000 lb. load | Welded |
| Step test seizure load, lb. | 1750 |
| Unit pressure, psi, step test | Welded |
| **Oil Viscosity, centiStokes** | |
| At 100°F | 13 |
| At −65°F | 8340 |

A grease with the fluid E formulation and 5.9 weight percent of the lithium stearate was prepared by the method which comprises mixing 2-mercaptobenzothiazole and antimony dialkylphosphorothioate with 4.5 weight percent of each of the two ester oils; dissolving said additives in said oils by heating said mixture to 107°C in one half hour; mixing the remainder of said oils, the silicone, the other additives, and lithium stearate in a separate container; heating the ingredients in the second container to 200°C in 10 minutes; chilling the contents of the second container to room temperature in less than 15 seconds to form a grease; combining the additive-oil solution with the newly formed grease; passing the grease through a three-roll mill three times; daerating the grease in vacuo; and aging the grease for three days at 50°C. This grease was compared with the grease in Table II in a number of tests in order to assess the improved performance of the grease of the present invention.

The first comparative test conducted was the salt spray corrosion test as detailed in Federal Test Method Standard No. 791. The test duration was 14 days, with daily visual examination. The test specimens consisted of 6 manganese phosphate coated sections of a M61A1 gun barrel and one section of a main bearing inner race of uncoated steel. Prior to testing, the specimens were scrubbed with an aliphatic naphtha solvent and allowed to dry. Table III gives the results of this test.

Table III

| Salt Spray Test Materials | | | |
|---|---|---|---|
| Specimen | Lubricant | Application | Results |
| Bearing Race | E | Dipped and shaken | Few cracks in grease film, several rust stains. Wiped surface had few dark stains with microscopic corrosion pits. |
| Barrel (1) | E | Brushed | No rusting, no effect on lubricant film. |
| Barrel (2) | E | Same | Slight rust stain at one point after 14 days. No rust or pitting seen after wiping. |
| Barrel (3) | II | Brushed | First rusting seen after one day. Extensive pitting with some scale formation. |
| Barrel (4) | E | Dipped and shaken (heavy coat) | Slight cracking of grease film during first week. No rusting. |
| Barrel (5) | E | Same | Slight cracking of grease film during first week. Slight rust stain at one point after 14 days. No rust or pitting seen after wiping. |
| Barrel (6) | None | None | Rusted all over after 1 day. Severe rusting and scaling. |

On phosphated steel lubricant E provided complete protection while lubricant II allowed extensive rusting which began on the first day. It should also be noted that lubricant E provided almost complete protection for the bare steel.

The second comparative test was the cold-sweat-cold firing test. This test comprises the steps of firing a complete 20 mm aircraft gun system, lubricated with the grease under test, at a temperature of −54°C; exposing the gun system to air at 15°C and 60% relative humidity to induce the formation of frost and condensation; cooling it again to −54°C; and again attempting to fire the gun.

The results of test are given in Table IV.

Table IV

| M61A1/A7E Gun Firing Rates | | | | | |
|---|---|---|---|---|---|
| Lubricant | Temp., °C | Hydraulic System | Firing Rate, Shots/min at 50 Rnd. | at 1.6 sec. | Steady |
| II | −54 | Cold | 1250 | 930 | — |

Table IV-continued

M61A1/A7E Gun Firing Rates

| Lubricant | Temp., °C | Hydraulic System | Firing Rate, Shots/min at 50 Rnd. | at 1.6 sec. | Steady |
|---|---|---|---|---|---|
| E | −53 | Warm | 4800 | 5000 | 5060 |
| E, after sweat-cold cycle | −53 | Warm | 4200 | 4550 | — |
| E, 2nd burst | −48 | Warm | 4400 | 4760 | 5150 |

The firing rate with lubricant II was lower partly due to the different temperature of the hydraulic drive motor. After the sweat-cold cycle with lubricant II the gun system was so immobilized by icing that it could not fire and could not be operated manually, but the gun system with lubricant E did fire successfully.

Lubricant E has thus been found superior in several respects to the lubricant currently in use on the M61A1 and similar gun systems. It provided greatly increased protection against salt water corrosion, high firing rates at low temperature, and a better ability to permit operation under cold-sweat-cold conditions.

Obviously many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A grease composition which comprises:

from 82 to 89 weight percent of an ester-silicone oil base selected from the group consisting of a blend of isodecyl pelargonate, hexadecyl isostearate, and methyl-phenyl silicone, a blend of isodecyl pelargonate, tridecyl azelate, and methylphenyl silicone, and a blend of ethylhexyl adipate and methyl-phenyl silicone;

from 4.9 to 7.5 weight percent of lithium stearate;

from 1.7 to 3 weight percent of a rust inhibitor selected from the class consisting of barium and lead dinonylnaphthalene sulfonate;

from 1.5 to 5 weight percent of antimony dialkylphosphorodithioate;

from 0.25 to 0.6 weight percent of a copper-silver corrosion inhibitor selected from the class consisting of tolyltriazol, disalicylal-propylene-diamine, and 2-mercaptobenzothiazole; and from 0.2 to 0.6 weight percent of 2,6-di-tert-butyl-4-methylphenol.

2. The grease composition of claim 1 wherein said ester-silicone oil base, based on total composition weight, is from 31 to 44 weight percent of isodecylpelargonate, from 26 to 39 weight percent of hexadecyl isostearate, and from 13 to 22 weight percent of methyl-phenyl silicone.

3. The grease composition of claim 1 wherein the estersilicone oil base, based on total composition weight, is from 35 to 50 weight percent of isodecyl pelargonate, from 25 to 40 weight percent of tridecyl azelate, and from 15 to 30 weight percent of methyl-phenyl silicone.

4. The grease composition of claim 1 wherein the estersilicone oil base, based on total composition weight, is from 70 to 85 weight percent of ethylhexyl adipate and from 15 to 30 weight percent of methyl-phenyl silicone.

5. The grease composition of claim 1 wherein said rust inhibitor is lead dinonylnaphthalene sulfonate.

* * * * *